US007445763B2

(12) United States Patent
Berger et al.

(10) Patent No.: US 7,445,763 B2
(45) Date of Patent: Nov. 4, 2008

(54) COATING POWDER OF CR OR V DOPED TITANIUM SUBOXIDES

(75) Inventors: Lutz-Michael Berger, Dresden (DE); Sven Thiele, Freiberg (DE); Manfred Nebelung, Dresden (DE)

(73) Assignee: Fraunhofer-Gesellschaft zur Förderung der Angewandten Forschung E. V. (DE)

( * ) Notice: Subject to any disclaimer, the term of this patent is extended or adjusted under 35 U.S.C. 154(b) by 691 days.

(21) Appl. No.: 10/469,935

(22) PCT Filed: Mar. 4, 2002

(86) PCT No.: PCT/EP02/02323

§ 371 (c)(1),
(2), (4) Date: Jan. 16, 2004

(87) PCT Pub. No.: WO02/079535

PCT Pub. Date: Oct. 10, 2002

(65) Prior Publication Data

US 2004/0136898 A1 Jul. 15, 2004

(30) Foreign Application Priority Data

Mar. 5, 2001 (DE) ..... 101 10 448

(51) Int. Cl.
*C23C 4/10* (2006.01)

(52) U.S. Cl. ..... 423/595; 423/594.8; 423/61; 423/62

(58) Field of Classification Search ..... 423/598, 423/71, 595, 61, 62, 594.8
See application file for complete search history.

(56) References Cited

U.S. PATENT DOCUMENTS

| | | | | |
|---|---|---|---|---|
| 3,816,348 | A * | 6/1974 | Popowich | 252/519.12 |
| 4,141,743 | A | 2/1979 | Grubba | 106/66 |
| 4,977,130 | A * | 12/1990 | Najjar et al. | 502/351 |
| 5,049,537 | A | 9/1991 | Najjar et al. | 502/350 |
| 5,173,215 | A | 12/1992 | Clarke | 252/520 |
| 5,281,496 | A | 1/1994 | Clarke | 429/218 |
| 6,017,592 | A | 1/2000 | Woydt et al. | 427/454 |
| 6,020,072 | A | 2/2000 | Woydt et al. | 428/472 |
| 6,524,750 | B1 * | 2/2003 | Mansuetto | 429/232 |

FOREIGN PATENT DOCUMENTS

| | | |
|---|---|---|
| DE | 195 11 628 A1 | 2/1996 |
| DE | 100 00 979 C1 | 12/2000 |
| EP | 1 054 075 A1 | 5/2000 |
| EP | 1061153 | 12/2000 |

OTHER PUBLICATIONS

Devi, P. Sujatha, "Preparation of Fine Particle Cr2Ti2O7 Powders by the Citrate Gel Process", Journal of Solid State Chemistry (1994), vol. 110, pp. 345-349, no month.

Yushchenko, K.A. et al., "Mechanical and Tribotechnical Properties of Thermal Sprayed Coatings", Surf. Eng., Pap. Int. Conf. (1993), pp. 23-32, no month.

* cited by examiner

*Primary Examiner*—Steven Bos
(74) *Attorney, Agent, or Firm*—Hayes Soloway P.C.

(57) ABSTRACT

A coating powder based on chemically modified titanium suboxides, for use in various coating techniques. Coatings produced from this powder are characterized by high electro-conductivity, good solid lubricating properties and resistance to wear. For these reasons, there are numerous possibilities of use of components which were coated by suitable processes with this powder, especially as functional layers for fuel cells in electrochemical installations, in the new car industry, in mechanical engineering and in other economic activities. The coating powder based on titanium suboxides having a defined defect structure is characterized in that it is modified by at least one metallic alloying element and described by general formula: $Ti_{n-2}Me_2O_{2n-1}$.

12 Claims, No Drawings

COATING POWDER OF CR OR V DOPED TITANIUM SUBOXIDES

FIELD OF THE INVENTION

The invention relates to a coating powder based on chemically modified suboxides of titanium of the general formula: $Ti_{n-2}Me_2O_{2n-1}$ for use in various coating methods including thermal spray technologies such as plasma spraying, high velocity oxy-fuel spraying (HVOF) and detonation spraying, as well as other coating methods using lasers and hybrid coating methods. By means of such coating methods the inventive coating powder can be applied to different components. The resulting coatings excel in providing high resistance to wear, oxidation and corrosion, high electroconductivity and good solid lubricating properties. Parts coated with the inventive powder are useful as functional components of fuel cells, in electrochemical installations, in the motor vehicle industry, mechanical engineering and other industries.

BACKGROUND OF THE INVENTION

Coating powders based on titanium suboxides have been described, together with a detailed description of the prior art, in DE 100 00 979 (to avoid repetitions, in this passage reference will be had only to said description). Such powders are characterized by the fact that in the formula $Ti_nO_{2n-1}$, "n" has a narrow range of n±2 or narrower and the coating powder particles have a particle size in the range of 10-90 μm. But it has been found in experiments with coatings sprayed from such powder, despite having an oxygen deficit compared to $TiO_2$, a disturbing partial oxidation is unavoidable in the coating process. In addition the planar defects typical of the titanium suboxides of the formula $Ti_nO_{2n-1}$ (Magneli phases) could not be transmitted to the thermally sprayed coatings (Berger L.-M., Thiele S., Nebelung M., Storz O., Gasthuber H., Spray Powders and Coatings on the Basis of Titanium Suboxides; in: Thermal Spray 2001; New Surfaces for a New Millennium, Proceedings of the International Thermal Spray Conference, 28-30 May 2001, Singapore, Ed.: C. C. Berndt, K. A. Khor, E. F. Lugscheider; Materials Park/Ohio; ASM International, 2001, p. 291-300).

One object of this invention is to provide coating powders based on suboxides of titanium having the structure of Magneli phases and which excel in resistance to oxidation and in which the planar defect structure of the Magneli phases can be transmitted to the coatings independently of the coating technique.

Another object of this invention is to provide a coating powder of the kind mentioned from which can be prepared coatings which excel in superior electroconductivity, solid lubricating properties and resistance to wear.

SUMMARY OF THE INVENTION

The foregoing and other objects of the invention are provided by the coating powder based on chemically modified titanium suboxides having a defined defect structure, wherein the powder is modified by at least one metallic alloying element and described by the general formula: $Ti_{n-2}Me_2O_{2n-1}$.

Independently of their preparation it is common to all inventive coating powders that they are modified by at least one metallic alloying element and can be described by the general formula: $Ti_{n-2}Me_2O_{2n-1}$. The coating powders advantageously contain one or more other alloying elements which stabilize separate phases of the general formula: $Ti_{n-2}Me_2O_{2n-1}$ or are inert.

DETAILED DESCRIPTION OF THE INVENTION

Titanium suboxides with planar defect structures (Magneli phases with the general formula $Ti_nO_{2n-1}$) can also be described as homologous series by the formula: x $TiO_2$*$Ti_2O_3$. They easily can be synthesized, in addition to the methods mentioned in DE 100 00 979, by a solid state reaction starting from mixtures of different molar ratios of $TiO_2$ and $Ti_2O_3$. $Ti_2O_3$ can be replaced in this reaction by a multiplicity of other trivalent metal oxides. But in the present state of the art there exist only a few trivalent metal oxides in which the reaction products have the structure of Magneli phases. This particularly refers to $Cr_2O_3$ and $V_2O_3$.

Modified titanium suboxides with the structure of Magneli phases which are described by the general formula: $Ti_{n-2}Cr_2O_{2n-1}$ with n≧4 can easily be prepared by solid state reaction of starting mixtures of different molar ratios of $TiO_2$ and $Cr_2O_3$. Pure titanium suboxides with the structure of Magneli phases are formed by reaction of $TiO_2$ and $Ti_2O_3$ only when the reaction is carried out in an inert atmosphere such as in argon. Prior to the present invention, Magneli phases of the structure $Ti_{n-2}Cr_2O_{2n-1}$ with n≧4 prepared formed in air. This means that such phases are oxidation resistant and thus do not have the serious disadvantages of the pure titanium suboxides with the structure of Magneli phases. The phase $Ti_{n-2}Cr_2O_{2n-1}$ with n=3 ($TiCr_2O_5$) forms only when stabilized by other alloying elements such as aluminum. Other alloying elements can have a stabilizing effect upon all phases of $Ti_{n-2}Cr_2O_{2n-1}$.

Modified titanium suboxides with the structure of Magneli phases which can be described by the general formula: $Ti_{n-2}V_2O_{2n-1}$ where n≧3, can also easily be prepared by using vanadium, for example, by the method mentioned in U.S. Pat. No. 5,049,537. But the toxicity of $V_2O_3$ and vanadium oxides of different valence of the vanadium requires increased cautionary steps in the synthesis of the Magneli phases during the preparation of the coating powders and in the processing thereof by thermal spraying.

It is also advantageous if "n" comprises in the formula $Ti_{n-2}Me_2O_{2n-1}$ a range of n±2. In case of strict requirements regarding the material it is possible, observing narrower technological parameter limits in the preparation, to implement a narrower range of n±1. In case of n<5 it is possible that in the coating powder there exist only phases which correspond to a discrete value for "n". This means that the coating powder is monophasic when for "n" is known only one phase. When several phases are known for a discrete "n", they can exist side-by-side. Due to the continuously smaller differences in the oxygen contents with increasing "n", the coating powders with n≧5 can be prepared in a manner that there exist together with the desired phase with "n" a second phase n+1 or n−1.

It is advantageous that the coating powder has a particle size in the range of 10-90 μm. In case of special requirements the coating powder also can have a particle size in the range of 10-45 μm.

The inventive coating powders can have different properties relative to their porosity and their morphology and can be prepared in different ways. A preferred variant consists in a synthesis carried out via a solid state reaction of homogeneous starting mixtures of finely dispersed titanium dioxide powder and trivalent metal oxide powder, preferably $Cr_2O_3$ and $V_2O_3$, of different molar ratios. The homogeneous starting mixtures can contain the other alloying elements, for example, in the form of oxides. But there are still multiple other possibilities of doping, metal powders or compounds of the alloying element which dissociate to form oxides can also be used. After the solid state reaction, an additional reduction with a solid or gaseous reduction agent can follow. Based on the different synthesis processes, there can be prepared finely disperse powders according to the formula $Ti_{n-2}Me_2O_{2n-1}$, preferably $Ti_{n-2}Cr_2O_{2n-1}$ and $Ti_{n-2}V_2O_{2n-1}$ which advantageously have a grain size <5 μm. After the synthesis, the suboxide $Ti_{n-2}$ $Me_2O_{2n-1}$ optionally can be ground and the grain size can be reduced.

The coating powder from the synthesized powders of the composition $Ti_{n-2}Me_2O_{2n-1}$ preferably is produced by agglomeration, sintering and fractionizing according to the process steps described in DE 100 00 979 without changing its phase composition. Spray drying is the preferred method for agglomeration. In one process variant the starting oxides $TiO_2$ and $Cr_2O_3$ are sprayed together in the necessary ratio and by reaction sintering the corresponding Magneli phases are obtained in the sintered coating powder. Another possibility of preparation consists of preserving, during the sintering of the coating powder, the phase composition of the previously synthesized powders. This is done, for example, by changing the sintering temperature in relation to the synthesis temperature. During sintering the grain size of the primary individual grains does not change or changes only slightly. The grain size of the individual grains sintered together in the coating powder particles preferably amounts to <5 μm. Usually no more than about 15% of the sintered coating powder particles are below the particle size range sought, and such value can be sharply reduced when needed by repeated fractionizing. Together with the existence of only one phase or of a narrow range of "n" in $Ti_{n-2}Me_2O_{2n-1}$ in the phase composition, these coating powders advantageously excel in spheric morphology and have a porosity above about 3%, preferably above about 10%, among other properties.

The porosity of the coating powders is determined by mercury porosimetry. In the calculation of the porosity the intruded volume at a pressure corresponding to a pore diameter of >1 μm is not taken into account, since the mercury is pressed into the cavities between the individual particles of coating powder. Due to the porosity and the fine individual particles these coating powders are also characterized by specific surface areas >1 $m^2/g$ .

Another possible process for preparation of the inventive coating powders consists in the synthesis of $Ti_{n-2}Me_2O_{2n-1}$ directly during the preparation of the coating powder by other methods such as fusing and crushing or sintering and crushing. Such coating powders easily can be further reduced with a gaseous reduction agent. At the same time the morphology, particle size and particle size distribution of the starting powder is substantially retained. These coating powders also can have a different morphology such as angular morphology and a porosity of <10%, preferably <5%.

The inventive coating powders can be processed to form coatings with different surface technologies. They are especially suitable for thermal spray processes, such as, for example, plasma spraying, high velocity oxy-fuel spraying (HVOF) and detonation spraying, as well as other coating methods using lasers and hybrid coating methods. In the coatings no changes or only few are detectable in the chemical and phase composition in comparison with the coating powder. Specially when using $Ti_{n-2}Cr_2O_{2n-1}$ there are no oxidation processes and thus no changes in the chemical and phase composition. The structure of the Magneli phases can be transmitted from the coating powder to the coating.

The coatings preferably are used as electrically conductive ceramic coatings which at the same time exhibit great mechanical resistance to wear and corrosion. They also can be used as solid lubricants and wear protection coatings. When the coatings are formed porous by selecting suitable coating parameters, they also are suitable for use as electrode coatings.

The inventive coating powder will now be described in detail in the following non-limiting example.

EXAMPLE 2 moles of a finely dispersed titanium dioxide powder and 1 mole of a finely dispersed chromium oxide powder $Cr_2O_3$ are intimately intermixed by grinding in a ball mill, compacted by pressing and brought to complete reaction (holding time 4 hours) in a furnace under air at 1380° C. A single-phase $Ti_2Cr_2O_7$ or in other words $2TiO_2*Cr_2O_3$ is formed. The powder is ground in a planetary ball mill into a finely dispersed state to a average grain size of 3.9 μm. The powder is then dispersed in water and ground in a ball mill for 16 hours, during which process the suspension is simultaneously mixed with 1.5 mass % of a binder consisting of polyvinyl alcohol and polyethylene glycol. Then granulated material of spherical shape was produced by spray drying. The release of the binder and sintering of the granulated material to form the coating powder takes place in a one-step annealing in flat graphite crucibles under argon at a heating rate of 5 K/min up to 600° C. K/min and a rate of 10 K/min until the sintering temperature of 130° C. with an isothermal holding period of 30 min. The sintered powders then were subjected to a careful grinding. The >45 μm fraction was separated by sieves, the <10 μm fraction by air sieving. The fine portion of the powder smaller than <10 μm amounted to 4% after fractionizing.

It was detected by X-ray phase analysis that the phase composition of the coating powder had not changed in comparison with the finely dispersed starting powder. The particle size distribution of the coating particles was measured by aid of a laser diffraction measuring apparatus by means of dry dispersion. The measurement resulted in the characteristic granulometric values $d_{10}$ of 15 μm, $d_{50}$ of 28 μm and $d_{90}$ of 43 μm. The inner open porosity of the coating powder was determined at 11% by means of mercury porosimetry. In the calculation of the porosity the intruded volume at a pressure corresponding to a pore diameter of >1 μm was not taken into account, since the mercury is pressed into the cavities between the individual particles of coating powder. The specific surface area of the powder amounted to 1.5 $m^2/g$.

The coating powder was subsequently applied to a steel substrate roughened by sand blasting immediately before the spraying by atmospheric plasma spraying (APS), using argon/hydrogen plasma with a power of 42 kW under gaseous flows of Ar 45 l/min and $H_2$ 10 l/min (each under standard conditions). The spraying distance was 110 mm and the powder feed rate was 35 g/min. A coating thickness of about 330 μm was obtained. In the sprayed coating $Ti_2Cr_2O_7$ was detected by X-ray phase analysis.

Various changes may be made in the above described invention without departing from the spirit and scope thereof.

We claim:

1. A coating powder based on chemically modified titanium suboxides having a defined defect structure of the Magneli phase, wherein the powder is modified by at least one metallic alloying element and described by the general formula:

$$Ti_{n-2}Me_2O_{2n-1}$$

wherein n is an integer having a numeric value of at least 3, Me is Cr or V, and the coating powder has a particle size in the range of 10-90 μm.

2. The coating powder according to claim 1, wherein the at least one metallic alloying element is chromium and the composition of the powder is described by the general formula:

$$Ti_{n-2}Me_2O_{2n-1}$$

where n≧4.

3. The coating powder according to claim 1, wherein the at least one metallic alloying element is chromium and the composition of the powder is described by the general formula:

$$Ti_{n-2}Me_2O_{2n-1}$$

where n≧3, the composition being stabilized by another metallic alloying element.

4. The coating powder according to claim 1, wherein the at least one metallic alloying element is vanadium and the composition of the powder is described by the general formula;

$$Ti_{n-2}Me_2O_{2n-1}$$

where n≧3.

5. The coating powder according to claim 1, wherein "n" in a range n±2.

6. The coating powder according to claim 1, wherein "n" is in a range n±1.

7. The coating powder according to claim 1, wherein only one phase is detectable which corresponds to a discrete value for "n" when "n" is <5.

8. The coating powder according to claim 1, wherein two phases are detectable when "n" is ≧5.

9. The coating powder according to claim 1, wherein said coating powder has a particle size in the range of 10-45 μm.

10. The coating powder according to any one of claims 1-9, wherein said coating powder has a spheric morphology, an open porosity larger than about 3% and consists of individual grains sintered together of the grain size range of about 5 μm.

11. The coating powder according to claim 10, wherein the open porosity of the coating powder consisting or individual particles sintered together is greater than about 10%.

12. The coating powder according to any one of claims 1-9, wherein the coating powder has an angular morphology and an open porosity of less than about 10%.

* * * * *